US008980809B2

(12) United States Patent
Yu et al.

(10) Patent No.: US 8,980,809 B2
(45) Date of Patent: Mar. 17, 2015

(54) CUTTING FLUIDS WITH IMPROVED PERFORMANCE

(75) Inventors: Wanglin Yu, Midland, MI (US); Daniel A. Aguilar, Lake Jackson, TX (US); John B. Cuthbert, Midland, MI (US); Linda Yi-Ping Zhu, Shanghai (CN)

(73) Assignee: Dow Global Technologies LLC, Midland, MI (US)

( * ) Notice: Subject to any disclaimer, the term of this patent is extended or adjusted under 35 U.S.C. 154(b) by 477 days.

(21) Appl. No.: 13/500,560

(22) PCT Filed: Oct. 16, 2009

(86) PCT No.: PCT/CN2009/001149

§ 371 (c)(1), (2), (4) Date: Apr. 5, 2012

(87) PCT Pub. No.: WO2011/044716

PCT Pub. Date: Apr. 21, 2011

(65) Prior Publication Data

US 2012/0196779 A1 Aug. 2, 2012

(51) Int. Cl.

| | |
|---|---|
| ***C10M 173/02*** | (2006.01) |
| ***C08G 63/00*** | (2006.01) |
| ***C10M 169/04*** | (2006.01) |
| ***C10M 107/34*** | (2006.01) |

(52) U.S. Cl.

CPC ..... *C10M 169/041* (2013.01); *C10M 107/34* (2013.01); *C10M 2201/061* (2013.01); *C10M 2201/10* (2013.01); *C10M 2207/122* (2013.01); *C10M 2207/123* (2013.01); *C10M 2207/124* (2013.01); *C10M 2209/084* (2013.01); *C10M 2209/086* (2013.01); *C10M 2209/10* (2013.01); *C10M 2209/104* (2013.01); *C10M 2209/1045* (2013.01); *C10M 2221/02* (2013.01); *C10N 2220/021* (2013.01); *C10N 2220/082* (2013.01); *C10N 2230/04* (2013.01); *C10N 2240/401* (2013.01)

USPC ..... 508/507; 508/494

(58) Field of Classification Search

USPC ..... 508/494, 507

See application file for complete search history.

(56) References Cited

U.S. PATENT DOCUMENTS

| | | | | |
|---|---|---|---|---|
| 3,478,732 | A | 11/1969 | Clark et al. | |
| 3,525,324 | A | 8/1970 | Bonnefoy et al. | |
| 5,269,275 | A | 12/1993 | Dahlgren | |
| 5,270,271 | A | 12/1993 | Lundin et al. | |
| 6,673,754 | B1 | 1/2004 | Nabeshima et al. | |
| 2004/0255924 | A1 | 12/2004 | Kondo et al. | |
| 2009/0053976 | A1 * | 2/2009 | Roy et al. | 451/36 |
| 2009/0317355 | A1 * | 12/2009 | Roth et al. | 424/78.31 |

FOREIGN PATENT DOCUMENTS

| | | | |
|---|---|---|---|
| JP | 2006111728 | A * | 4/2006 |
| WO | 03042340 | A1 | 5/2003 |
| WO | 2004/106407 | A1 | 12/2004 |
| WO | 2009134236 | A1 | 11/2009 |

* cited by examiner

*Primary Examiner* — Vishal Vasisth

(74) *Attorney, Agent, or Firm* — Whyte Hirschboeck Dudek S.C.

(57) ABSTRACT

The cutting of semiconducting crystals with a wire saw is facilitated with a cutting fluid comprising a polyalkylene glycol neutralized with an un-neutralized or partially neutralized polymeric acid that has a molecular weight of 500 to 1,000,000 and contains more than three acid groups per molecule.

13 Claims, 4 Drawing Sheets

CUTTING FLUIDS WITH IMPROVED PERFORMANCE

This application is a 371 of PCT/CN2009/001149, filed Oct. 16, 2009.

FIELD OF THE INVENTION

This invention relates to cutting fluids. In one aspect the invention relates to cutting fluids comprising polyalkylene glycol (PAG) while in another aspect, the invention relates to cutting fluids comprising PAG neutralized with a polymeric acid. In yet another aspect, the invention relates to a process for making PAG and in still another aspect, the invention relates to a method of cutting a semiconducting crystal.

BACKGROUND OF THE INVENTION

Wire saw cutting is widely used in slicing semiconducting crystals, such as silicon ingot, gallium arsenide (GaAs), gallium phosphide (GaP), and the like to produce wafers for making electronic and photovoltaic devices. The wire saw slicing works through abrasive grinding action provided by an abrasive slurry consisting of a cutting fluid and abrasive particles, generally of silicon carbide (SiC), suspended in the fluid. The cutting fluid plays a critical role in achieving efficient and precise slicing by (i) suspending and carrying abrasive particles and swarf (i.e., semiconductor crystal chips produced the cutting of the crystal), (ii) lubricating the workpiece, and (iii) removing the frictional heat generated at the cutting site.

Polyalkylene glycols (PAG), in particular polyethylene glycols (PEG), are commonly used as semiconductor crystal cutting fluids. The demand for semiconductor wafers continues to grow, especially in the photovoltaic market, and with it a demand for a more cost-effective production of silicon wafers. The cost and quality of silicon wafer production can be improved by boosting cutting speed, increasing wafer yield, reducing total thickness variation (TTV) of wafers, reducing saw marks and warp, decreasing wafer thickness, and prolonging the lifetime of cutting wires. All these improvements require higher performance cutting fluids that can more effectively disperse the abrasive, e.g., SiC particles, and crystal, e.g., silicon, swarf particles.

One known solution is to add a dispersant, such as polyelectrolyte, to the PAG to produce formulated PAG-based cutting fluids. However, this additional formulation step increases the complexity and cost of the cutting fluid production. The invention is to produce PAG materials as cutting fluids with improved dispersing ability for SiC and Si particles but does not need the additional step of adding dispersants.

BRIEF SUMMARY OF THE INVENTION

In one embodiment the invention is a polyalkylene glycol neutralized with a polymeric acid.

In one embodiment the invention is a process of producing a neutralized polyalkylene glycol, the process comprising the steps of:

A. Polymerizing an alkylene oxide using a base catalyst to form a basic PAG; and B. Neutralizing the basic PAG with a neutralizing amount of a polymeric acid.

The polymerization is initiated with one or more of water, an alkylene glycol, an oligomer of an alkylene glycol, or an aliphatic or aromatic mono-, di-, tri- or multi-functional alcohol. The base catalyst is typically sodium or potassium hydroxide.

In one embodiment the invention is a cutting fluid comprising a PAG neutralized with a polymeric acid. The polymeric acid neutralized PAG of this invention can be used alone or in combination with one or more other PAG that are either conventionally neutralized or admixed with a recycled PAG material. If used in combination with one or more other PAG that are either conventionally neutralized or admixed with a recycled PAG material, then the polymeric acid neutralized PAG of this invention typically comprises at least 30, preferably at least 50, volume percent of the combination.

In one embodiment the invention is a method of cutting a brittle material with a wire saw, the method comprising the step of applying a cutting fluid comprising a PAG neutralized with a polymeric acid to the material as the material is cut with the wire saw. In one embodiment, the brittle material is a semiconductor crystal or ingot.

The polymeric acid is a polymer with a molecular weight from 500 to 1,000,000, and it typically contains three or more acid groups per molecule. The polymeric acids used in the practice of this invention are not neutralized or only partially neutralized so that they can provide sufficient acidity to neutralize the residual base catalyst in the PAG.

The polymeric acid neutralized PAG of this invention shows significant improvement in dispersing abrasive SiC and silicon powders as compared to conventionally produced PAG cutting fluids. The invention provides a cutting fluid of high performance and a cost-effective process of making it.

DESCRIPTION OF THE PREFERRED EMBODIMENT

Figure 1:
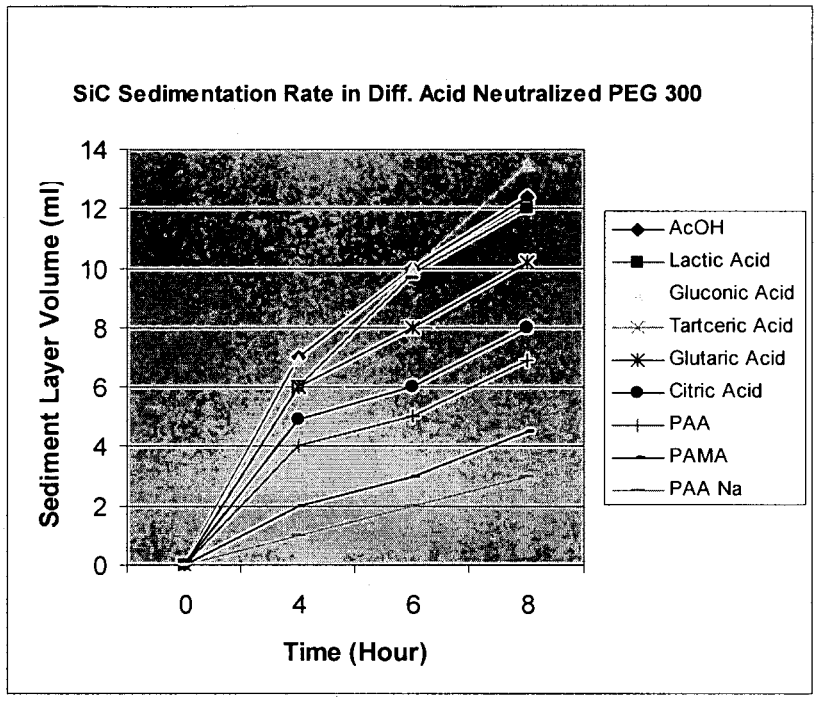
FIG. 1 is a graph reporting the silicon carbide sedimentation rates of polyethylene glycol 300 neutralized with different acids.

Unless stated to the contrary, implicit from the context, or customary in the art, all parts and percents are based on weight and all test methods are current as of the filing date of this disclosure. For purposes of United States patent practice, the contents of any referenced patent, patent application or publication are incorporated by reference in their entirety (or its equivalent US version is so incorporated by reference) especially with respect to the disclosure of synthetic techniques, definitions (to the extent not inconsistent with any definitions specifically provided in this disclosure), and general knowledge in the art.

The numerical ranges in this disclosure are approximate, and thus may include values outside of the range unless otherwise indicated. Numerical ranges include all values from and including the lower and the upper values, in increments of one unit, provided that there is a separation of at least two units between any lower value and any higher value. As an example, if a compositional, physical or other property, such as, for example, molecular weight, viscosity, melt index, etc., is from 100 to 1,000, it is intended that all individual values, such as 100, 101, 102, etc., and sub ranges, such as 100 to 144, 155 to 170, 197 to 200, etc., are expressly enumerated. For ranges containing values which are less than one or containing fractional numbers greater than one (e.g., 1.1, 1.5, etc.), one unit is considered to be 0.0001, 0.001, 0.01 or 0.1, as appropriate. For ranges containing single digit numbers less than ten (e.g., 1 to 5), one unit is typically considered to be 0.1. These are only examples of what is specifically intended, and all possible combinations of numerical values between the lowest value and the highest value enumerated, are to be considered to be expressly stated in this disclosure. Numerical ranges are provided within this disclosure for, among other things, the component amounts of the cutting fluid and various process parameters.

Polyalkylene Glycol (PAG)

One embodiment of the invention is the production of a polyalkylene glycol by the polymerization of an alkylene oxide monomer or a mixture of alkylene oxide monomers initiated by one or more of water and a mono-, di- or polyhydric compound, and promoted by a base catalyst under reactive conditions known in the art (see, for example, "Alkylene Oxides and Their Polymers", *Surfactant Science Series*, Vol. 35). Upon the completion of the polymerization, the reaction mixture is vented and it is neutralized by the addition of one or more polymeric acids. The neutralized polyalkylene glycol product has a pH value of 4.0 to 8.5 and is useful as wafer cutting fluid.

In one embodiment the initiator is ethylene or propylene glycol or an oligomer of one of them. In one embodiment, the initiator is a compound of the formula $$R^1O—(CHR^2CH_2O)_m—R^3$$

in which $R^1$ and $R^3$ are independently a $C_1$ to $C_{20}$ aliphatic or aromatic group with linear or branched structure and which may contain one or more unsaturated bonds, or hydrogen, with the proviso that at least one of $R^1$ and $R^3$ is hydrogen; each $R^2$ is independently hydrogen, methyl, or ethyl; and m is an integer of 0 to 20. In one embodiment the starter compound is a hydrocarbon compound containing 3 or more hydroxyl groups, such as glycerol or sorbitol.

The catalyst is a base, typically at least one of an alkali or alkaline earth metal hydroxide or carbonate, aliphatic amine, aromatic amine, or a heterocyclic amine. In one embodiment, sodium or potassium hydroxide is the base catalyst.

The alkylene oxide used as the monomer in the polymerization is a $C_2$ to $C_8$ oxide, such as ethylene oxide, propylene oxide, butylene oxide, hexene oxide, or octene oxide. In one embodiment, the alkylene oxide is ethylene or propylene oxide.

In one embodiment of this invention the polyalkylene oxide is polyethylene oxide, or a water soluble copolymer of ethylene oxide (EO) and propylene oxide (PO), or a mono methyl, ethyl, propyl, or butyl ether of one of them, or a polyethylene oxide or a copolymer of EO and PO initiated by glycerol. In one embodiment, the polyalkylene glycol has an average molecular weight of 130-1,000, more typically of 200-600.

Polymeric Acid

The polymeric acid used in the practice of this invention typically has a molecular weight of 500 to 1,000,000 and contains more than three acid groups per molecule. The acid groups are typically one or more of carboxylic acid, maleic acid, sulfonic acid or phosphoric acid that have either been incorporated into the polymer backbone or have been grafted to the polymer backbone through a carbon-carbon (C—C), ester, ether, or other covalent chemical bond. In one embodiment the polymeric acid is a copolymer containing alkylene oxide units to promote the solubility of the acid or its neutralized salt in the cutting fluid product. The polymeric acid used in the practice of this invention is in an un-neutralized or partially neutralized (e.g., less than or equal to (≤) 75%, typically ≤50%) acidic state so that it can provide sufficient acidity to neutralize the base catalyst in the polyalkylene glycol.

In one embodiment the typical molecular weight of the polymeric acid is in the range of 500 to 500,000, more typically in the range of 1000 and 10,000.

In one embodiment the polymeric acid is a homo- or copolymer of acrylic acid, methacrylic acid, maleic acid, styrene sulfonic acid, or 2-acrylamido-2-methylpropyl sulfonic acid and is grafted by polyalkylene oxide or mono-alkyl or aryl ether of polyalkylene oxide through an ester or ether linkage. In one embodiment the polymeric acid is polyalkylene oxide radically grafted by one or more of acrylic acid, methacrylic acid, maleic acid, styrene sulfonic acid, or 2-acrylamido-2-methylpropyl sulfonic acid. In one embodiment an acid group or a polymeric acid chain is linked with alkylene oxide repeat units through a C—C or ether bond that is hydrolytically stable.

Cutting Fluid

The cutting fluids of this invention comprise a base-catalyzed polyalkylene glycol that is neutralized with a polymeric acid. The polymeric acid, or a mixture of polymeric acids, can be added to the polyalkylene glycol neat or in a solution of water or a polar solvent, such as one or more of an alcohol, glycol, glycol ether, amide, ester, ketone or sulfoxide. Sufficient polymeric acid is added to the polyalkylene glycol such that the cutting fluid has a pH in the range of 4.0 to 8.5, or 4.5 to 8.0, or 5.0 to 7.5. Typically the polymeric acid is added to the base-catalyzed polyalkylene glycol at the end of the polymerization reaction as a solution of polymeric acid in a polar solvent or water at a concentration of 1 to 99 weight percent, (wt %) and more typically at a concentration of 5 to 60 wt %.

The cutting fluid may contain other ingredients as well, such as polar solvents (e.g., alcohols, amides, esters, ethers, ketones, glycol ethers or sulfoxides), thickeners (e.g., xanthan gum, rhamsan gum or an alkyl-cellulose such as hydroxymethylcellulose, carboxymethylcellulose), surfactants, biocides, anti-corrosion agents, dyes, fragrances and the like. These other ingredients are used in known manners and in known amounts. The cutting fluids of this invention comprise little, if any, water. If water is present, then it is typically present in an amount of less than 15, more typically less than 5 and even more typically less than 1, wt %.

In one embodiment the cutting fluid comprises a base-catalyzed polyalkylene glycol represented by the formula $$R^1O—(CHR^2CH_2O)_nH,$$

in which $R^1$ is a $C_1$ to $C_{20}$ aliphatic or aromatic group with a linear or branched structure and may contain one or more unsaturated bonds, or hydrogen; R2 is hydrogen, methyl, or ethyl; and n is an integer of 1 to 50, neutralized or partially neutralized with a polymeric acid to a pH of 4.0 to 8.5. The amount of polyalkylene glycol in the cutting fluid is typically 80 to 99.5, more typically 90 to 99.5 and even more typically 95 to 99 wt %. The amount of polymeric acid in the cutting fluid is typically 0.01 to 5, more typically 0.05 to 3 and even more typically 0.1 to 2 percent by weight (wt %). The total amount of additives in the cutting fluid is typically 0.01 to 10, more typically 0.05 to 5 and even more typically 0.1 to 3 percent by weight (wt %).

Use of the Cutting Fluid

Ultimately the cutting fluid is mixed with an abrasive material to form a cutting slurry. Abrasive material that can be used in the practice of this embodiment of the invention include diamond, silica, tungsten carbide, silicon carbide, boron carbide, silicon nitride, aluminum oxide or other hard grit powder or similar material. One of the most preferred abrasive materials is silicon carbide. Generally, mean or average particle sizes range from about 2-50 microns; preferably from 5-30 microns and even more preferably 5-15 microns, depending on the international grade designations of the grit powder. The concentrations of the abrasive material in the cutting slurry typically range from 20 to 70, more typically from 25 to 60 and even more typically from 35-60, wt %.

The cutting slurry is used in a known matter. Typically it is sprayed upon a cutting wire as a work piece is brought into contact with the cutting wire. The cutting wire is part of a cutting apparatus commonly known as a wiresaw or wire-web, and it usually comprises a row of fine wires arranged parallel to each other and at a fixed pitch. A workpiece is pressed against these fine wires (which typically have a diameter of 0.1-0.2 millimeters (mm) running in parallel with one another in the same direction, while a cutting slurry is supplied between the workpiece and the wires, the workpiece sliced into wafers by an abrasive grinding action. The liquid suspended abrasive particles are coated onto the moving web or wire through a circulation system which drops a blanket-curtain of the cutting slurry onto the web just before the wire-web impacts the workpiece. Thus, the abrasive particles carried by the liquid are transferred by the coated wires to produce a grinding or cutting effect. These wiresaws are described more fully in U.S. Pat. Nos. 3,478,732, 3,525,324, 5,269,275 and 5,270,271.

The following examples are illustrative of certain embodiments of the present invention. All parts and percentages are based on weight except as otherwise indicated.

SPECIFIC EMBODIMENTS

Example 1

Polyethylene Glycol (PEG300) Materials Synthesis and Neutralization

A 5-gallon pressure reactor is purged with nitrogen and charged with 5201 grams (g) of diethylene glycol and 29.55 g of potassium hydroxide solution (45 wt % KOH). The reactor is filled with nitrogen to 20 pounds per square inch (psia) and heated to 135° C. Ethylene oxide (9850 g) is metered into the reactor between 130° C. and 140° C. at a pressure of about 20-50 psia over a period of 24 hours (hr). After the ethylene oxide feed is complete, the reactor is agitated at a reaction temperature of 135° C. for an additional 2 hr to consume unreacted oxide.

Upon the completion of the polymerization, about 1 liter of the reaction mixture is transferred to a flask under nitrogen protection. In a nitrogen-filled dry box, an acid as listed in Table 1 is added until the pH of the product is in the range of 5.0 to 7.5. The pH value is measured on a 5% aqueous solution of the product at room temperature by a pH meter. Acetic acid and other monocarboxylic acids, bicarboxylic acids, citric acid, polyacrylic acid (PAA), partially neutralized polyacrylic acid sodium salt (PAA Na), and poly(acrylic acid-co-maleic acid) are used to neutralized the crude product. The quantities of each of the acids added and the basic properties of the finished products are listed in Table 1.

TABLE 1

Cutting Fluids and Their Properties

| | Acid | | | | | | | | |
|---|---|---|---|---|---|---|---|---|---|
| | AcOH | Lactic Acid* | Gluconic Acid* | Tartaric Acid | Glutaric Acid | Citric Acid | PAA | PAANa* | PAMA* |
| Quantity of Acid (g) | 0.9 | 2.93* | 2.96* | 1.15 | 1.00 | 0.98 | 1.04 | 4.58* | 0.98* |
| Acid (wt)% | 0.09 | 0.30% | 0.31% | 0.12% | 0.10% | 0.10% | 0.11% | 0.47% | 0.10% |
| Water Content (% Calc.)# | 0.03 | 0.10% | 0.35% | 0.03% | 0.03% | 0.03% | 0.03% | 0.37% | 0.13% |
| pH | 6.8 | 6.7 | 6.9 | 5.8 | 6.6 | 6.9 | 10 | 7.2 | 7.5 |
| Color | Colorless | Colorless | Yellow | Colorless | Colorless | Colorless | Colorless | Colorless | Slightly Yellow |
| Clarity | Clear | Clear | Clear | Cloudy | Clear | Clear | Cloudy | Clear | Clear |
| Viscosity (cP @ 25° C.) | 69 | 69.5 | 71.5 | 68.0 | 70.0 | 70.5 | 70.5 | 69.0 | 69.5 |
| Note | | | | | | | PAA not sol. | | |

*Aqueous solution. Quantity is corrected to pure acid.

#Water content is calculated from neutralization reaction of acid and the water from acid if aqueous solution is used.

Example 2

Sedimentation Test of SiC Particles (#1200) in Different Acid Neutralized PEG Materials Into a 200 milliliter (ml) wide-mouth glass bottle is weighed 13.3±0.1 g of SiC (#1200 from Omex of China) and then 120±1 g of PEG 300 fluid. The capped bottle is shaken on a VWR DS-500 Orbital Shaker at 250 revolutions per minute (rpm) for 20 hr. The mixed sample is immediately added to a 100 ml graduated cylinder (±1 ml). The sediment layer volume at the bottom is recorded at different times. Lower sediment volume indicates better dispersion of the fluid to SiC particles. The results from the different acid neutralized PEG materials are reported in FIG. 1. Partially neutralized PAA and PAMA neutralized PEG 300 have significantly better dispersion of SiC particles than mono-, di-, and tri-acid neutralized PEG 300 materials. PAA is not soluble in PEG 300, so the product was not well neutralized.

Example 3

Sedimentation Test of Si Particles in Different Acid Neutralized PEG Materials

Figure 2:
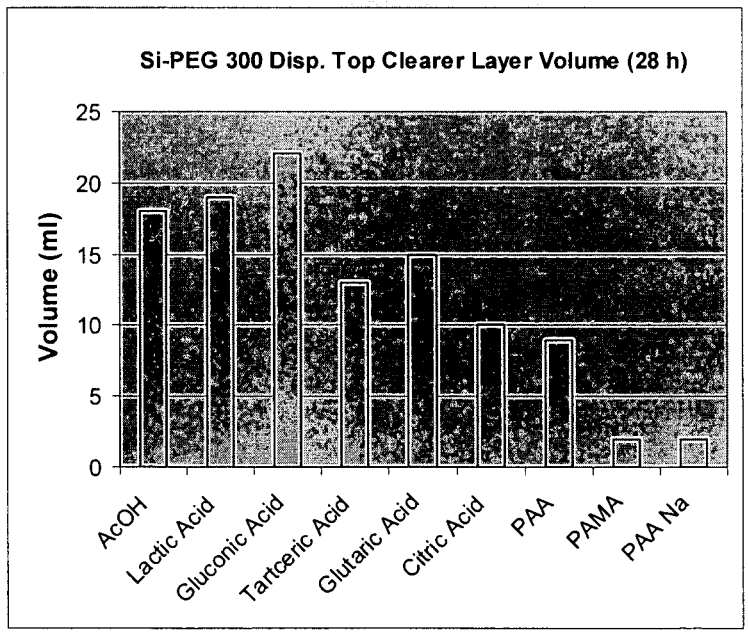
FIG. 2 is a chart reporting the top clear volume of sedimentation test samples containing silicon particles and polyethylene glycol 300 neutralized with different acids.

Into a 200 ml wide-mouth glass bottle is weighed 13.3±0.1 g of Si powder (99.0+%, size<10 micron, Atlantic Equipment Engineers) and then 120±1 grams of PEG 300 fluid. The capped bottle is shaken on a VWR DS-500 Orbital Shaker at 250 rpm for 24 hr. The mixed sample is immediately added to a 100 ml graduated cylinder (±1 ml). The cylinder is stoppered and allowed to stand undisturbed at room temperature. After 28 hr the volume of the top clear layer was recorded. The results from the different acid neutralized PEG materials are reported in FIG. 2. A lower clear layer volume means better dispersion of Si powders. The results show that the PEG 300 materials neutralized by partially neutralized PAA (Na PAA) and PAMA have significantly better dispersion of Si powders than the PEG 300 materials neutralized by mono-, di-, and tri-acids.

Figure 3:
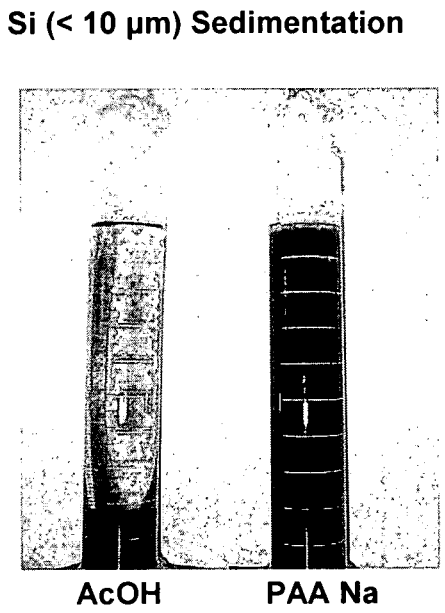
FIG. 3 is a photograph of silicon powder dispersions comparing the sedimentation of a dispersion containing PEG 300 neutralized with partially neutralized (by NaOH) polyacrylic acid and polyethylene glycol 300 neutralized with acetic acid.

Pictures of the Si powder dispersions in Na PAA and Acetic Acid neutralized PEG 300 materials are taken after 6 days of standing undisturbed at room temperature and are shown in FIG. 3. The Si powders in the Na PAA neutralized sample are still well dispersed, while the powders in acetic acid neutralized PEG are completely settled.

Example 4

Viscosity of SiC-PEG Slurry in Different Acid Neutralized PEG Materials

Figure 4:
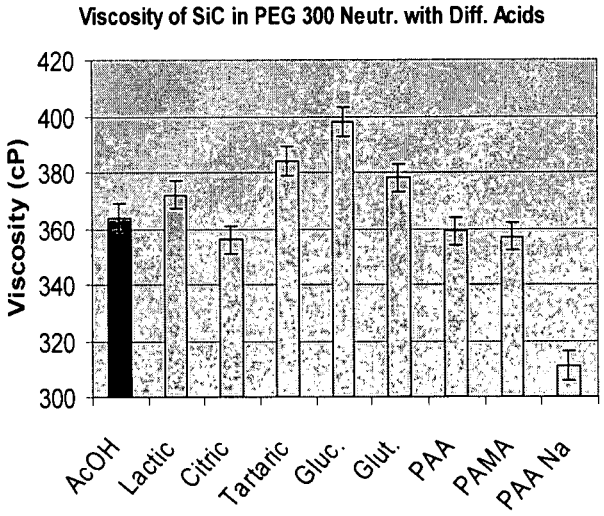
FIG. 4 is a chart reporting the viscosity of test samples comprising SiC particles and polyethylene glycol 300 neutralized with different acids.

SiC particles (#1200 from Omex) and a neutralized PEG 300 made as described above are mixed at 1:1 (wt/wt) and stirred at 1000 rpm with a Lightnin mixer using a Cowles blade for 10 minutes (min) to form a SiC-PEG slurry. Viscosity of the slurry is measured on a Brookfield Rheometer at 25° C. using a #31 spindle and small sample adaptor. The viscosities of the slurries in different acid neutralized PEG 300 materials are reported in FIG. 4. The slurry made from Na PAA neutralized PEG 300 has a considerably lower viscosity than those neutralized by other acids, indicating less agglomeration of particles in Na PAA neutralized PEG material.

Example 5

Figure 5:
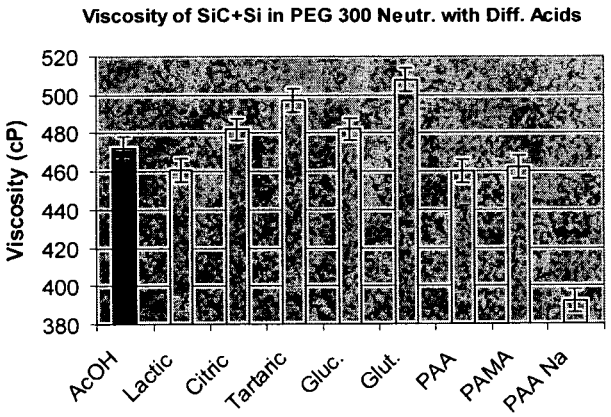
FIG. 5 is a chart reporting the viscosity of test samples comprising SiC particles, silicon powder (swarf) and polyethylene glycol 300 neutralized with different acids.

Viscosity of SiC-PEG Slurry Containing Si Powder (Swarf) in Different Acid Neutralized PEG Materials SiC particles (#1200 from Omex) and a neutralized PEG 300 made as described above are mixed at 1:1 (wt/wt) and then 5 wt % of Si powders (99.0+%, size<10 micron, Atlantic Equipment Engineers) is added. The mixture is stirred at 1000 rpm for 10 min with a Lightnin mixer using a Cowles blade to form a SiC-PEG slurry. Viscosity of the slurry is measured on a Brookfield Rheometer at 25° C. using a #31 spindle and small sample adaptor. The viscosities of the slurries in different acid neutralized PEG 300 materials are compared in FIG. 5. The Si powder containing slurry made from Na PAA neutralized PEG 300 has considerably lower viscosity than those neutralized by other acids, indicating less agglomeration of particles in Na PAA neutralized PEG material.

Example 6

Polyethylene Glycol (PEG300) Materials Synthesis and Neutralization by Polymeric Acids Following the procedure of the preparation and neutralization of PEG 300 as described in Example 1, PEG 300 materials are prepared and neutralized by different polymeric acids as listed in Table 2.

TABLE 2

Cutting fluids and Their Properties

| | Acid | | | | | | |
|---|---|---|---|---|---|---|---|
| | AcOH | EPML-483* | EDTA | PSA[a] | Acusol 102[b] | TMAH-EPML 483[c] | TMAH-PAA[d] |
| Quantity of Acid (g) | 1.10 | 12.71 | 2.00 | 21.80 | 56.00 | 49.10 | 22.70 |
| Acid (wt %) | 0.11 | 1.28 | | 0.41 | 2.96 | 2.65 | 1.21 |
| Water Content (% Calc.)[#] | 0.03 | 0.03 | | 1.90 | 0.03 | 2.90 | 1.60 |
| pH | 5.6 | 7.0 | Insol. | 7.4 | 5.4 | 7.0 | 7.6 |
| Color | Colorless | Light Yellow | Insol. | Colorless | Light yellow | Colorless | Colorless |
| Clarity | Clear | Clear | Insol. | Clear | Clear | Clear | Clear |

*EPML-483 is a copolymer of propylene oxide and ethylene oxide and radically grafted by acrylic acid.

[#]Water content is calculated from neutralization reaction of acid and the water from acid if aqueous solution is used.

[a]PSA = Poly(4-styrenesulfonic acid), 18% (Mw 81000) aqueous solution (Aldrich).

[b]50% solution in propanol. A polyglycol grafted polyacrylic acid product from Rohm and Haas.

[c]50% EPML 483 solution in water and neutralized 50% by tetramethyl ammonium hydroxide (TMAH).

[d]PAA = Polyacrylic acid. 60% aqueous soution (Mw 2000) and 50% neutralized by TMAH.

Example 7

Sedimentation Test of SiC Particles (#1200) in Different Polymeric Acid Neutralized PEG 300 Materials Into a 200 ml wide-mouth glass bottle is weighed 13.3±0.1 g of SiC (#1200 from Omex) and then 120±1 g of PEG 300 fluid. The capped bottle is shaken on a VWR DS-500 Orbital Shaker at 250 rpm for 20 hr. The mixed sample is immediately added to a 100 ml graduated cylinder (±1 ml). The sediment layer volume at the bottom is recorded at different times. Lower sediment volume indicates better dispersion of the fluid to SiC particles. The results from different polymeric acid neutralized PEG materials are compared in Table 3.

TABLE 3

Sediment Volumes over Time

| | Sediment Layer Volume (ml) | | |
|---|---|---|---|
| Time (hr) | 4.5 | 6.5 | 9 |
| PEG 300/AcOH | 6.9 | 9.2 | 12.5 |
| PEG 300/EPML-483 | 1 | 2 | 4 |
| PEG 300/PSA | 0 | 0.1 | 0.2 |
| PEG300/ACUSOL 102 | Too much foam. Did not test. | | |
| PEG 300/EPML-483 (50% neutralized w/TMAH) | 0.5 | 1 | 2 |
| PEG 300/PAA 50% neutralized w/TMAH | 0.3 | 1 | 2 |

The results show that compared to the conventionally acetic acid-neutralized PEG 300, the polymeric acid-neutralized PEG 300 materials better suspend SiC particles.

Example 8

Viscosity of SiC Slurry in Polymeric Acid Neutralized PEG 300

Figure 6:
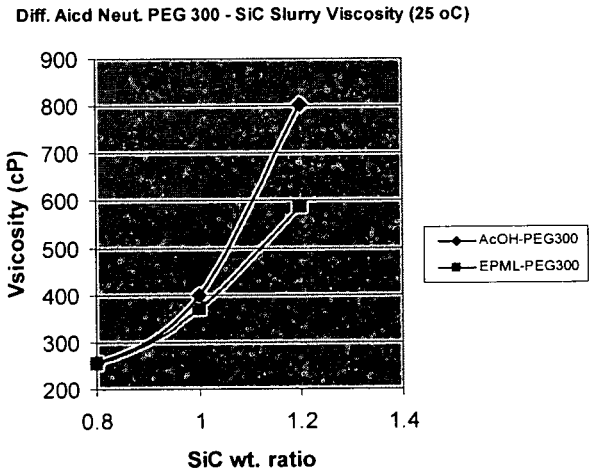
FIG. 6 is a graph reporting the viscosity of test slurries comprising SiC particles in polyethylene glycol 300 neutralized with different acids.

SiC particles (#1200) and EPML-483 neutralized PEG 300 made in Example 6 are mixed at 0.8:1, 1:1 and 1.2:1 (wt/wt), respectively, and stirred at 1000 rpm with a Lightnin mixer using a Cowles blade for 10 min to form a SiC-PEG slurry. Viscosity of the slurry is measured on a Brookfield Rheometer at 25° C. using a #31 spindle and small sample adaptor. The viscosities of the slurries are compared with those of the slurries made from conventionally acetic acid-neutralized PEG 300 in FIG. 6. The viscosity increase with the increase of SiC loading is slower in the EPML-483 neutralized PEG 300 than in the conventionally acetic acid neutralized PEG 300.

Figure 7:
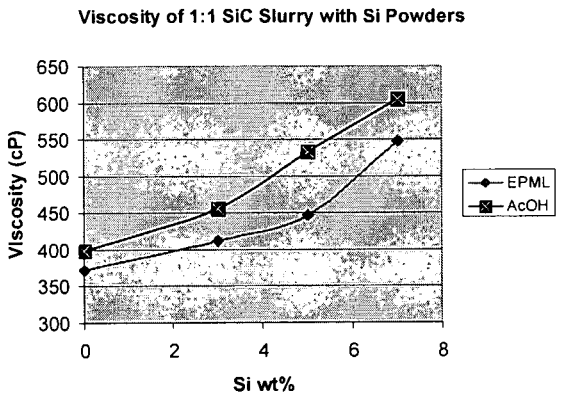
FIG. 7 is a graph reporting the viscosity of test slurries comprising SiC particles, silicon powder and polyethylene glycol 300 neutralized with different acids.

SiC particles (#1200) and EPML-483 neutralized PEG 300 made in Example 6 are mixed at 1:1 (wt/wt) and then 3, 5 and 7 wt % of Si powders (99.0+%, size <10 micron, Atlantic Equipment Engineers) are added. The mixture is stirred at 1000 rpm for 10 min with a Lightnin mixer using a Cowles blade to form a SiC-PEG slurry. Viscosity of the slurry is measured on a Brookfield Rheometer at 25° C. using a #31 spindle and small sample adaptor. The viscosity of the Si-containing slurry is compared with the similar slurry made from the conventionally acetic acid neutralized PEG 300 materials are reported in FIG. 7. The viscosity of the slurry made from EPML-483 neutralized PEG 300 has lower viscosity at different amount of Si powders added compare to those made from the conventionally acetic acid neutralized PEG 300.

Example 9

Polyethylene Glycol (PEG200) Materials Synthesis and Neutralization

Following a similar procedure as described in Example 1, PEG 200 materials finished by acetic acid, EPML-483, poly (4-styrenesulfonic acid) (PSA), 50% TMAH-neutralized EPML-483, and 30% TMAH-neutralized polyacrylic acid are prepared.

Example 10

Sedimentation Test of SiC Particles (#1200) in Different Polymeric Acid Neutralized PEG 200 Materials Into a 200 ml wide-mouth glass bottle is weighed 13.3±0.1 g of SiC (#1200 from Omex) and then 120±1 grams of a PEG 200 fluid made in Example 9. The capped bottle is shaken on a VWR DS-500 Orbital Shaker at 250 rpm for 20 hr. The mixed sample is immediately added to a 100 ml graduated cylinder (±1 ml). The sediment layer volume at the bottom is recorded at different times. Lower sediment volume indicates better dispersion of the fluid to SiC particles. The results from different polymeric acid neutralized PEG materials are reported in Table 4.

TABLE 4

Sediment Volume over Time

| | Sediment Layer Volume (ml) | | | |
|---|---|---|---|---|
| Time (hr) | 2.5 | 4 | 5 | 8 |
| PEG 200/AcOH | 5 | 8 | 9 | 15 |
| PEG 200/PSA | 0 | 0.2 | 0.3 | 2 |
| PEG 200/50% TMAH-neutralized EPML 483 | 1.5 | 2.5 | 3 | 5 |
| PEG 200/EPML 483 | 0.5 | 1 | 1.5 | 3 |
| PEG 200/30% TMAH-neutralized PAA | 1 | 2 | 2.5 | 4 |

The data shows that the PEG 200 materials finished by polymeric acids have better suspension to SiC particles than the conventionally acetic acid neutralized PEG 200.

Example 11

Viscosity of SiC Slurry in Polymeric Acid Neutralized PEG 200

Figure 8:
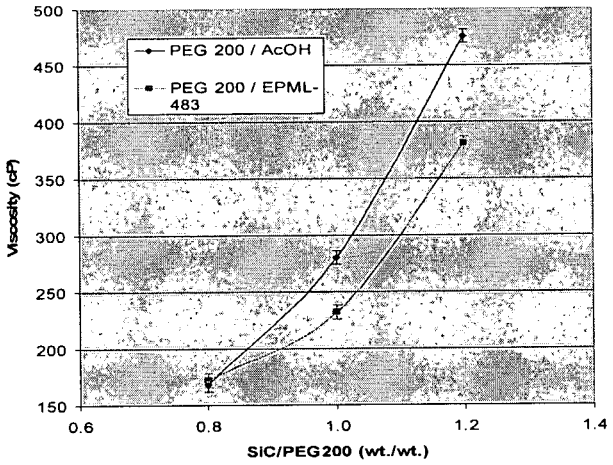
FIG. 8 is a graph reporting the viscosity of test slurries comprising SiC particles and polyethylene glycol 200 neutralized with different acids.

SiC particles (#1200 from Omex) and EPML-483 neutralized PEG 200 made in Example 10 are mixed at 0.8:1, 1:1, and 1.2:1 (wt/wt), respectively, and stirred at 1000 rpm with a Lightnin mixer using a Cowles blade for 10 min to form a SiC-PEG slurry. Viscosity of the slurry is measured on a Brookfield Rheometer at 25° C. using a #31 spindle and small sample adaptor. The viscosities of the slurries are compared with those of the slurries made from conventionally acetic acid-neutralized PEG 200 in FIG. 8. The viscosity of the slurry made from EPML-483 neutralized PEG 200 increases slower with the increase of SiC particles loading than that made from the conventionally acetic acid neutralized PEG 200.

Example 12

Sedimentation Test of SiC Particles (#1200) in Mixture of Polymeric Acid Neutralized PEG 200 Materials and Conventional Acetic Acid Neutralized PEG200

Into a 200 ml wide-mouth glass bottle is weighed 13.3±0.1 g of SiC (#1200 from Omex) and then 120±1 grams of a mixture of EPML-483 neutralized PEG 200 fluid made in Example 9 and a conventional acetic acid neutralized PEG 200 at the weight ratio of 1:1. The capped bottle is shaken on a VWR DS-500 Orbital Shaker at 250 rpm for 20 hours. A similar SiC dispersion in the conventional acetic acid neutralized PEG 200 is made as a comparison. The mixed sample is immediately added to a 100 ml graduated cylinder (±1 ml). The sediment layer volume at the bottom is recorded. After 2 hours the sediment layer volume in the sample made from conventional acetic acid neutralized PEG 200 is 4.5 ml, and the sediment layer volume in the sample made from the mixture of EPML-483 neutralized PEG 200 and conventional acetic acid neutralized PEG 200 is about 0.1 ml, indicating significantly better dispersion in the mixed PEG 200 sample.

Although the invention has been described with certain detail through the preceding specific embodiments, this detail is for the primary purpose of illustration. Many variations and modifications can be made by one skilled in the art without departing from the spirit and scope of the invention as described in the following claims.

What is claimed is:

1. A polyalkylene glycol product obtainable by polymerization of alkylene oxide using a base catalyst, wherein the base catalyst and polyalkylene glycol are neutralized with an un-neutralized or partially neutralized polymeric acid that has a molecular weight of 500 to 1,000,000 and contains more than three acid groups per molecule, wherein the polymeric acid is selected from the group consisting of polyalkylene oxide radically grafted by one or more of acrylic acid, methacrylic acid, maleic acid, styrene sulfonic acid, 2-acrylamido-2-methylpropyl sulfonic acid; a homo- or copolymer of acrylic acid, methacrylic acid, maleic acid, styrene sulfonic acid, or 2-acrylamido-2-methylpropyl sulfonic acid; a homo- or copolymer of acrylic acid, methacrylic acid, maleic acid, styrene sulfonic acid, or 2-acrylamido-2-methylpropyl sulfonic acid that is grafted with a polyalkylene oxide or a mono-alkyl or aryl ether of polyalkylene oxide; and combinations thereof.

2. The polyalkylene glycol product of claim 1 in which the polymeric acid is a homo- or copolymer of acrylic acid, methacrylic acid, maleic acid, styrene sulfonic acid, or 2-acrylamido-2-methylpropyl sulfonic acid and is grafted by a polyalkylene oxide or a mono-alkyl or aryl ether of polyalkylene oxide.

3. The polyalkylene glycol product of claim 1 in which the polymeric acid is a homo- or copolymer of acrylic acid, methacrylic acid, maleic acid, styrene sulfonic acid, or 2-acrylamido-2-methylpropyl sulfonic acid.

4. A process of producing a neutralized polyalkylene glycol cutting fluid, the process comprising the steps of:

A. Polymerizing an alkylene oxide using a base catalyst to form a basic PAG; and B. Neutralizing the basic PAG with a neutralizing amount of an un-neutralized or partially neutralized polymeric acid that has a molecular weight of 500 to 1,000,000 and contains more than three acid groups per molecule, wherein the polymeric acid is polyalkylene oxide radically grafted by one or more of acrylic acid, methacrylic acid, maleic acid, styrene sulfonic acid, or 2-acrylamido-2-methylpropyl sulfonic acid; a homo- or copolymer of acrylic acid, methacrylic acid, maleic acid, styrene sulfonic acid, or 2-acrylamido-2-methylpropyl sulfonic acid; a homo- or copolymer of acrylic acid, methacrylic acid, maleic acid, styrene sulfonic acid, or 2-acrylamido-2-methylpropyl sulfonic acid that is grafted with a polyalkylene oxide or a mono-alkyl or aryl ether of polyalkylene oxide; and combinations thereof, wherein the cutting fluid comprises the neutralized PAG and the polymeric acid or its neutralized salt.

5. The process of claim 4 in which the polymeric acid is a homo- or copolymer of acrylic acid, methacrylic acid, maleic acid, styrene sulfonic acid, or 2-acrylamido-2-methlypropyl sulfonic acid.

6. The process of claim 4 in which the polymeric acid is a homo- or copolymer of acrylic acid, methacrylic acid, maleic acid, styrene sulfonic acid, or 2-acrylamido-2-methylpropyl sulfonic acid and is grafted with a polyalkylene oxide or mono-alkyl or aryl ether or polyalkylene oxide.

7. A cutting fluid comprising a PAG that is polymerized by using a base catalyst and an un-neutralized or partially neutralized polymeric acid, wherein the PAG and the base catalyst are neutralized with the un-neutralized or partially neutralized polymeric acid, the polymeric acid having a molecular weight of 500 to 1,000,000 and contains more than three acid groups per molecule, wherein the polymeric acid is a polyalkylene oxide that is radically grafted by one or more of acrylic acid, methacrylic acid, maleic acid, styrene sulfonic acid, or 2-acrylamido-2-methylpropyl sulfonic acid; a homo- or copolymer of acrylic acid, methacrylic acid, maleic acid, styrene sulfonic acid, or 2-acrylamido-2-methylpropyl sulfonic acid; or such a homo- or copolymer that is grafted with a polyalkylene oxide or a mono-alkyl or aryl ether of polyalkylene oxide, and wherein the cutting fluid comprises the neutralized polyalkylene glycol and the polymeric acid or its neutralized salt.

8. The polyalkylene glycol product of claim 1 in which the polymeric acid is polyalkylene oxide radically grafted by one or more of acrylic acid, methacrylic acid, maleic acid, styrene sulfonic acid, or 2-acrylamido-2-methylpropyl sulfonic acid.

9. The process of claim 4 in which the polymeric acid is polyalkylene oxide radically grafted by one or more of acrylic acid, methacrylic acid, maleic acid, styrene sulfonic acid, 2-acrylamido-2-methylpropyl sulfonic acid.

10. The cutting fluid of claim 7 further comprising a second PAG, wherein the PAG polymerized using a base catalyst and an un-neutralized or partially neutralized polymeric acid is present in an amount of at least 30 volume percent based on the total volume of the PAG polymerized using a base catalyst and an un-neutralized or partially neutralized polymeric acid and the second PAG.

11. The cutting fluid of claim 7 in which the polymeric acid is a polyalkylene oxide that is radically grafted by one or more of acrylic acid, methacrylic acid, maleic acid, styrene sulfonic acid, or 2-acrylamido-2-methylpropyl sulfonic acid.

12. The cutting fluid of claim 7 in which the polymeric acid is a homo- or copolymer of acrylic acid, methacrylic acid, maleic acid, styrene sulfonic acid, or 2-acrylamido-2-methylpropyl sulfonic acid.

13. The cutting fluid of claim 7 in which the polymeric acid is a homo- or copolymer of acrylic acid, methacrylic acid, maleic acid, styrene sulfonic acid, or 2-acrylamido-2-methylpropyl sulfonic acid grafted with a polyalkylene oxide or a mono-alkyl or aryl ether of polyalkylene oxide.

* * * * *